US005877931A

United States Patent [19]

Groppo et al.

[11] Patent Number: 5,877,931

[45] Date of Patent: Mar. 2, 1999

[54] DEVICE FOR CONTROLLING INDUCTIVE LOADS, IN PARTICULAR OF INJECTORS OF AN INTERNAL COMBUSTION ENGINE INJECTION SYSTEM

[75] Inventors: Riccardo Groppo, Roletto; Giancarlo Casellato, Turin, both of Italy

[73] Assignee: C.R.F. Societa' Consortile Per Azioni, Turin, Italy

[21] Appl. No.: 897,465

[22] Filed: Jul. 21, 1997

[30] Foreign Application Priority Data

Jul. 23, 1996 [IT] Italy ..... T096A0637

[51] Int. Cl.[6] ..... H01H 47/32

[52] U.S. Cl. ..... 361/152; 361/154; 361/155; 361/156; 361/191

[58] Field of Search ..... 361/152–156, 361/160, 191; 123/490

[56] References Cited

U.S. PATENT DOCUMENTS

| | | | |
|---|---|---|---|
| 4,173,031 | 10/1979 | Leichle | 361/191 |
| 4,327,693 | 5/1982 | Busser | 361/155 |
| 4,862,866 | 9/1989 | Calfus | 361/155 |
| 4,933,805 | 6/1990 | Calfus | 361/152 |
| 4,950,974 | 8/1990 | Pagano | 361/191 |
| 5,150,687 | 9/1992 | Paganon et al. | 361/154 |
| 5,499,157 | 3/1996 | Ypunessi et al. | 361/191 |
| 5,552,954 | 9/1996 | Glehr | 361/191 |
| 5,717,562 | 2/1998 | Antone et al. | 361/155 |

FOREIGN PATENT DOCUMENTS

| | | |
|---|---|---|
| A-622 536 | 11/1994 | European Pat. Off. . |
| A-2-538 942 | 7/1984 | France . |
| A-2-569 238 | 2/1986 | France . |
| WO 87/05075 | 8/1987 | WIPO . |

*Primary Examiner*—Fritz Fleming
*Attorney, Agent, or Firm*—Oliff & Berridge, PLC

[57] ABSTRACT

The control device has a drive circuit, in turn having a number of modular circuits—one for each inductor—activated selectively and receiving timing signals, and a common circuit connected to the modular circuits and cooperating with the activated modular circuit to supply the respective inductor. Each modular circuit has a first controlled switch connected between a first input terminal and a respective first output terminal, and a second controlled switch connected between the respective first output terminal and a storage capacitor; and the common circuit has a third controlled switch connected between the storage capacitor and a respective second output terminal, and cooperating with the second controlled switch to selectively transfer energy between the storage capacitor and the respective inductor.

14 Claims, 3 Drawing Sheets

DEVICE FOR CONTROLLING INDUCTIVE LOADS, IN PARTICULAR OF INJECTORS OF AN INTERNAL COMBUSTION ENGINE INJECTION SYSTEM

BACKGROUND OF THE INVENTION

The present invention relates to a device for controlling inductive loads, in particular of injectors of an internal combustion engine injection system.

As is known, to control the injectors of an internal combustion engine injection system, each injector must be supplied with current, the curve of which comprises a rapidly increasing portion, a more slowly increasing portion, a portion decreasing to a hold value, a portion oscillating about the hold value, and a portion decreasing to zero.

To achieve such a curve, control devices are currently employed whereby the inductive loads of the injectors are connected on one side to a low-voltage supply source, and on the other side to a ground line via a controlled electronic switch. A major drawback of control devices of this sort is that, in the event of ground shorting of one of the terminals of any one of the inductive loads—e.g. due to impaired insulation of of an injector conductor, and contact between the conductor and the vehicle body—the injector and/or control device is irreparably damaged and the engine is turned off—an extremely dangerous situation when the vehicle is moving.

To eliminate the above hazard, control devices have been proposed whereby the inductive loads of the injectors are grounded on one side and connected on the other side to an internal node of the control device itself, so that, as opposed to damaging the control device and turning off the engine, ground shorting of one of the terminals of the inductive loads simply results in that particular injector being put out of use, so that the vehicle continues running minus one injector.

Such control devices, however, in addition to involving complex, high-cost circuitry, normally fail to provide for simultaneously injecting different cylinders, as required for example by engine injection systems involving multiple injection of each cylinder.

SUMMARY OF THE INVENTION

It is an object of the present invention to provide a straightforward, low-cost control device designed to overcome the aforementioned drawbacks.

According to the present invention, there is provided a device for controlling inductive loads, in particular of injectors of an injection system of an internal combustion engine, comprising:

timing means generating timing signals for controlling said injectors;

drive means for driving said inductive loads and comprising a number of modular circuits, one for each inductive load; said modular circuits being activated selectively and receiving said timing signals;

said drive means also comprising a common circuit comprising energy storing means; said common circuit being connected to the modular circuits and cooperating with the activated modular circuit to supply a respective inductive load;

said drive means also comprising a first and a second input terminal respectively connected, in use, to a positive pole and a negative pole of a supply source; and a number of pairs of output terminals, one for each injector; each pair of output terminals comprising a first and a second output terminal between which a respective inductive load is connected in use;

characterized in that each of said modular circuits comprises, in combination:

first controlled switching means connected between said first input terminal and a respective first output terminal of said drive means; and second controlled switching means connected between said respective first output terminal and said energy storing means;

and in that said common circuit comprises:

third controlled switching means connected between said energy storing means and a respective second output terminal of said drive means; said third controlled switching means cooperating with said second controlled switching means to permit selective transfer of energy between said energy storing means and said respective inductive load.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
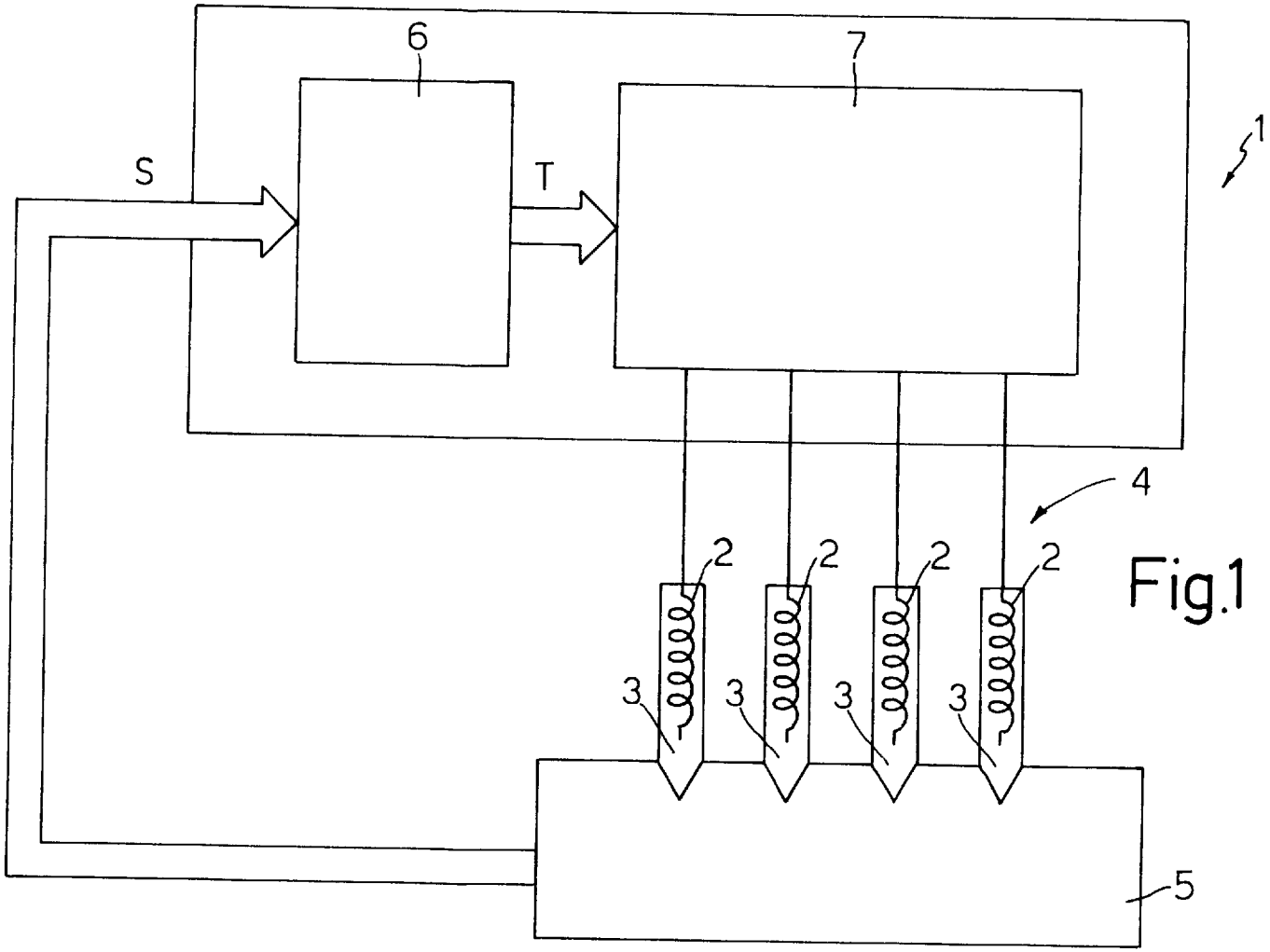
FIG. 1 shows a block diagram of an injection system comprising a control device in accordance with the present invention.
Figure 2:
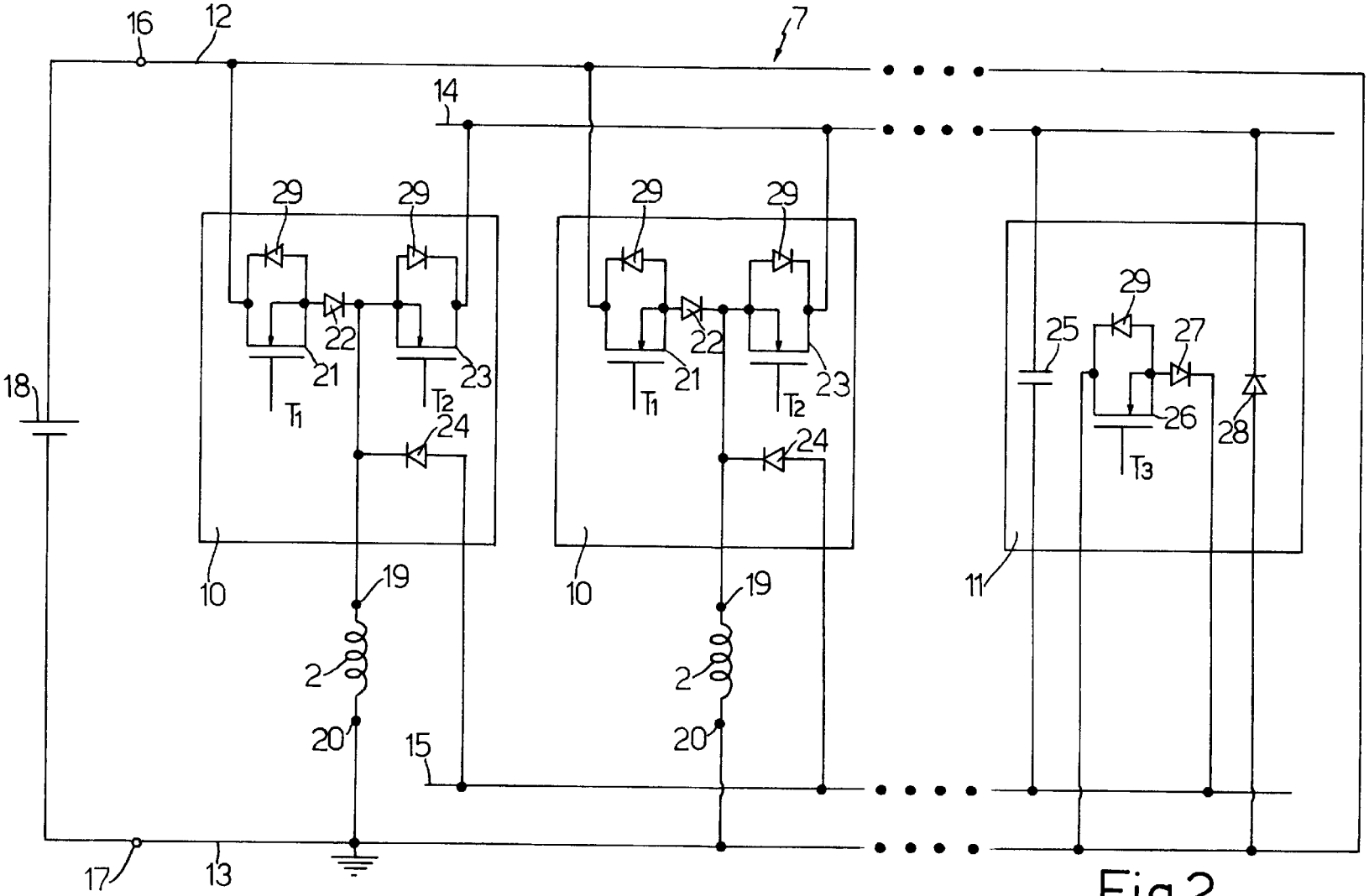
FIG. 2 shows a circuit diagram of the FIG. 1 control device.

Number 1 in FIG. 1 indicates a device for controlling the control electromagnets of injectors 3 of an injection system 4 of an internal combustion engine 5, in particular a supercharged diesel engine. In FIG. 1, the control electromagnets are represented by the electric equivalents comprising inductors 2.

Control device 1 comprises a timing circuit 6 receiving information signals S measured on engine 5, and generating timing signals T for controlling injectors 3; and a modular circuit 7 receiving timing signals T and for driving injectors 3 accordingly.

Modular circuit 7 comprises a number of modular circuits 10, one for each inductor 2, activated selectively and receiving timing signals T as described in detail later on; and a common circuit 11 connected to modular circuits 10 and cooperating with the activated modular circuit 10 to supply respective inductor 2 as also described in detail later on.

More specifically, modular circuit 7 comprises a supply line 12; a ground line 13; and a first and second connecting line 14, 15 between modular circuits 10 and common circuit 11.

Modular circuit 7 also comprises a first and second input terminal 16, 17 respectively connectable to a positive pole and a negative pole of a supply source, e.g. a battery 18; and a number of pairs of output terminals, one for each injector 3. Each pair of output terminals comprises a first and second output terminal 19, 20 between which a respective inductor 2 is connected in use. More specifically, the first input terminal 16 of modular circuit 7 is connected to supply line 12, and the second input terminal 17 and the second output terminals 20 are connected to ground line 13.

Each modular circuit 10 comprises a MOSFET charging transistor 21 having a control terminal connected to timing circuit 6 and receiving from timing circuit 6 a first timing signal $T_1$, a drain terminal connected to supply line 12, and a source terminal connected to the anode of a charging diode 22, the cathode of which is connected to a respective first output terminal 19 of modular circuit 7.

Modular circuit 10 also comprises a MOSFET discharging transistor 23 having a control terminal connected to timing circuit 6 and receiving from timing circuit 6 a second timing signal $T_2$, a drain terminal connected to first connecting line 14, and a source terminal connected to respective first output terminal 19 of modular circuit 7.

Modular circuit 10 also comprises a clamping diode 24 with the anode connected to second connecting line 15, and the cathode connected to respective first output terminal 19 of modular circuit 7.

Common circuit 11 comprises a capacitor 25 having a first and second terminal connected respectively to first connecting line 14 and second connecting line 15.

Common circuit 11 also comprises a MOSFET recirculating transistor 26 having a control terminal connected to timing circuit 6 and receiving from timing circuit 6 a third timing signal $T_3$, a drain terminal connected to ground line 13, and a source terminal connected to the anode of a recirculating diode 27, the cathode of which is connected to second connecting line 15.

Common circuit 11 also comprises a discharging diode 28 with the anode connected to ground line 13, and the cathode connected to first connecting line 14.

The drain and source terminals of each transistor 21, 23, 26 of modular circuits 10 and common circuit 11 are connected respectively to the cathode and anode of a respective protection diode 29 operating in known manner and therefore not described in detail.

Timing circuit 6 selectively activates each modular circuit 10 by supplying the control terminals of transistors 21, 23, 26 with timing signals $T_1$, $T_2$, $T_3$, which are only supplied to the modular circuit to be activated, so that the other modular circuits 10 remain off. Furthermore, timing signals $T_1$, $T_2$, $T_3$, control MOSFET transistors 21, 23, 26 to saturate them or to switch them off, so that each transistor acts as a closed or open switch.

Operation of control device 1 will now be described with reference to one injector 3 and one modular circuit 10—the other modular circuits operating in the same way—which cooperates with common circuit 11 to supply respective inductor 2, and with specific reference to FIGS. 3 to 7 showing time graphs of timing signals $T_1$, $T_2$, $T_3$ of transistors 21, 23, 26, the voltage $V_C$ of capacitor 25, and the current flow $I_L$ in inductor 2.

To begin with, timing circuit 6 opens all of transistors 21, 23, 26, so that both modular circuit 10 and common circuit 11 are off.

Figure 3:
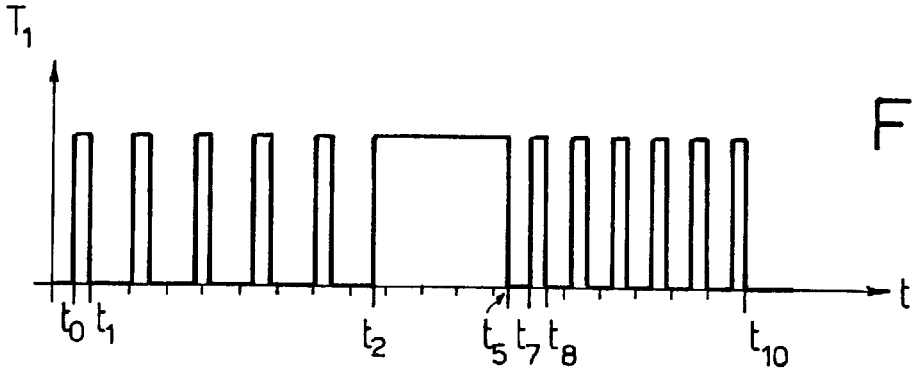
FIGS. 3 to 7 show time graphs of quantities relative to the FIG. 2 control device.
Figure 4:
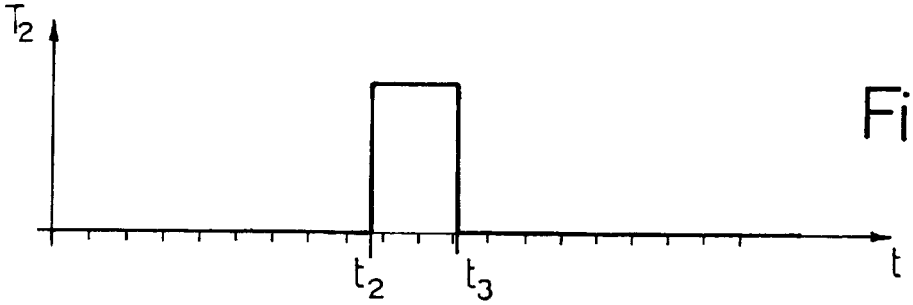
Figure 5:
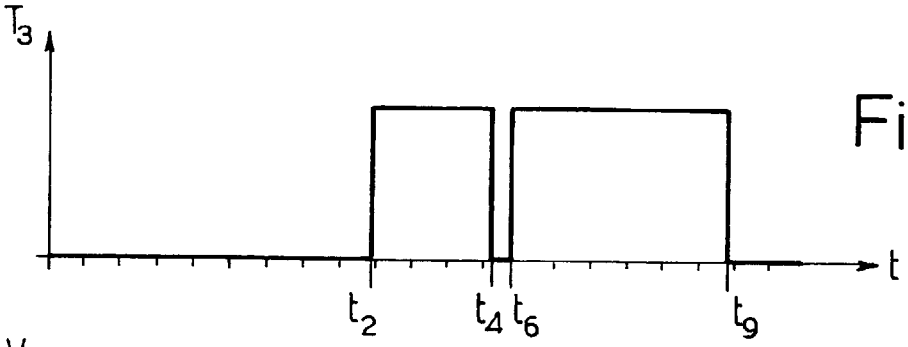

Timing circuit 6 then closes and opens, several times in succession, the charging transistor 21 of the modular circuit 10 activated at the time, by supplying the control terminal of charging transistor 21 with a train of so-called recharging pulses, as shown in FIG. 3 (RECHARGING PHASE). More specifically, when charging transistor 21 is closed (instant $t_0$ in FIG. 3), a closed loop is formed comprising battery 18, charging transistor 21, charging diode 22 and inductor 2; and inductor 2, being supplied by battery 18 with a constant voltage, is supplied with an increasing current, which increases the energy stored in inductor 2.

When charging transistor 21 is opened (instant $t_1$ in FIG. 3), current flow in the above loop is cut off so that energy ceases to be stored in inductor 2; and the time interval $t_1$–$t_0$ in which charging transistor 21 is closed is so calculated that the energy stored in inductor 2 is insufficient to open respective injector 3.

When charging transistor 21 is opened, capacitor 25 and inductor 2 are connected to each other in series via discharging diode 28 and clamping diode 24 to form a resonant circuit, so that current flows in the loop defined by inductor 2, discharging diode 28, capacitor 25 and clamping diode 24, thus charging capacitor 25 and increasing the voltage at the terminals of capacitor 25, so that the energy stored in inductor 2 is transferred, minus any losses, to capacitor 25.

Figure 6:
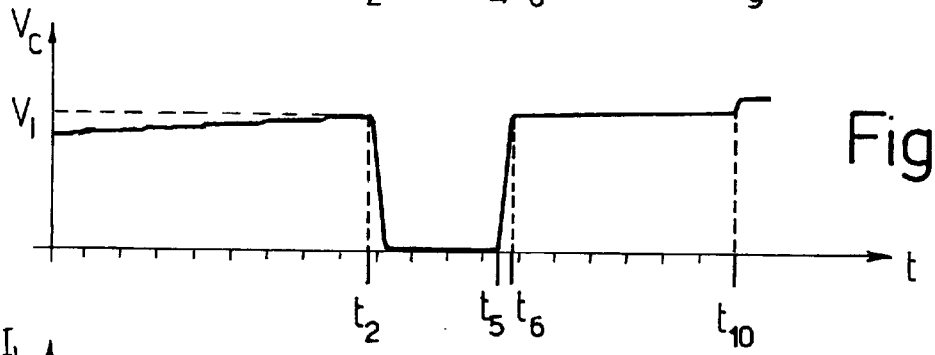
Figure 7:
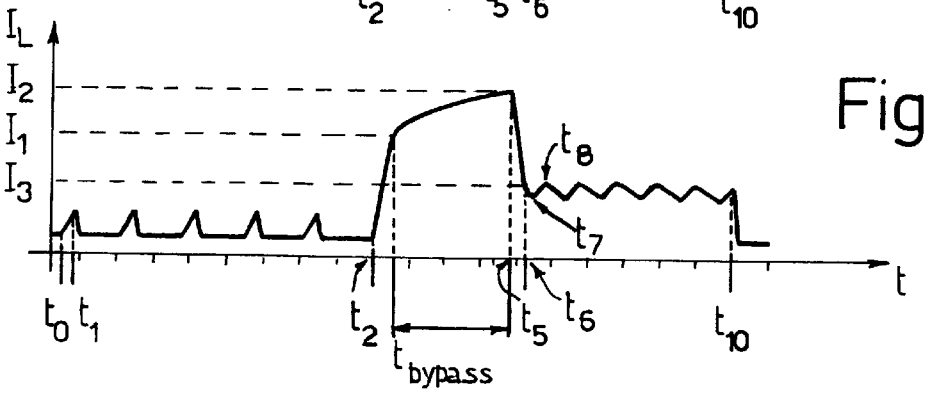

As shown in FIG. 6, by closing and opening charging transistor 21 several times in succession, the voltage at the terminals of capacitor 25 (which is assumed to have been precharged in previous drive cycles and therefore at an initial voltage value of other than zero) gradually increases to a predetermined value $V_1$ calculated to permit control of inductor 2 of injector 3; and, as shown in FIG. 7, the current flow in inductor 2, as the inductor is charged and discharged, assumes a saw-tooth pattern.

Timing circuit 6 then closes recirculating transistor 23 and discharging transistor 26 sequentially (instant $t_2$ in FIGS. 4 and 5) to form a further closed loop comprising capacitor 25, inductor 2, transistors 23, 26 and recirculating diode 27, and so form a further resonant circuit, so that a current flow is generated to discharge capacitor 25, reduce the voltage at the terminals of capacitor 25, and transfer all the energy stored in capacitor 25 to inductor 2, as shown in FIG. 6 (RESONANT DISCHARGE PHASE).

As capacitor 25 is being discharged, the current flow in inductor 2 reaches a predetermined value $I_1$ calculated to open injector 3 instantaneously.

Upon the voltage at the terminals of capacitor 25 reaching a value $V_2$ equal to the voltage of battery 18 minus the threshold voltage of charging diode 22, charging diode 22 begins conducting and again connects inductor 2 in series with battery 18, which supplies inductor 2 with a constant voltage, so that the inductor is supplied with increasing current to keep injector 3 open (BYPASS PHASE). The current flow in inductor 2 therefore continues increasing, as shown in FIG. 7, but at a slower rate than before.

After a predetermined time interval ($t_{bypass}$ in FIG. 7, by the end of which the current in inductor 2 has reached a predetermined value $I_2$), timing circuit 6 opens discharging transistor 23 (instant $t_3$ in FIG. 4), recirculating transistor 26 (instant $t_4$ in FIG. 5) and charging transistor 21 (instant $t_5$ in FIG. 3) to form a closed loop comprising capacitor 25, inductor 2 (which combine to form a resonant circuit), clamping diode 24 and discharging diode 28, and to generate a current flow to charge capacitor 25 and discharge inductor 2 (DELAY PHASE).

Discharging inductor 2 permits recharging of capacitor 25, thus reducing the number of recharging pulses required in the next drive cycle, and hence recharging time, and also reducing the time interval between one injection and the next.

Rapid discharging of inductor 2 continues until timing circuit 6 closes recirculating transistor 26 (instant $t_6$ in FIG. 5), at which point, the voltage at the terminals of capacitor 25 is at a value $V_2$ close to $V_1$, and current flow in the loop is at a value $I_3$ below $I_1$.

When recirculating transistor 26 is closed, inductor 2 and capacitor 25 are no longer connected in series, and current, due to the energy stored in inductor 2, flows in the loop defined by inductor 2, recirculating transistor 26, recirculating diode 27 and clamping diode 24. In this phase, the current decreases at a slower rate than before (CHOPPER OFF PHASE).

After a predetermined time interval (instant $t_7$), timing circuit 6 closes and opens charging transistor 21 several times in succession by supplying a train of pulses to the control terminal, and the current flow in inductor 2 assumes a saw-tooth pattern oscillating about a predetermined mean value sufficient to keep injector 3 open. More specifically, timing circuit 6 closes charging transistor 21 (instant $t_7$), so that inductor 2 is once more connected in series with battery 18 via charging transistor 21 and charging diode 22; the current flow in inductor 2 therefore increases to charge inductor 2 (CHOPPER ON PHASE) until timing circuit 6 opens charging transistor 21 (instant $t_8$ in FIG. 3) to disconnect inductor 2 from battery 18, so that current is supplied to the loop defined by inductor 2, recirculating transistor 26, recirculating diode 27 and clamping diode 24; which current partially discharges inductor 2 (CHOPPER OFF PHASE) until timing circuit 6 again closes charging transistor 21, and the CHOPPER ON PHASE is repeated.

Following injection, timing circuit 6 sequentially opens recirculating transistor 26 and charging transistor 21 (instants $t_9$ and $t_{10}$ in FIGS. 5 and 6), so that capacitor 25 and inductor 2 are once more connected in series via clamping diode 24 and discharging diode 28 to form a resonant circuit, and the discharge current of inductor 2 charges and increases the voltage of capacitor 25 (RESONANT RECHARGING PHASE). This phase continues until inductor 2 is completely discharged, thus terminating the drive cycle of injector 3; at which point, timing circuit 6 may commence a further drive cycle of another injector 3 as described above.

The advantages of control device 1 are as follows. Firstly, by virtue of each inductor 2 being connected to control device 1 as described above, ground shorting of one of the terminals of inductor 2 in no way damages injector 3 or control device 1, but simply results in exclusion of injector 3, with no impairment in the operation of the other injectors 3, and without the engine suddenly being turned off.

Secondly, control device 1 provides for simultaneously driving a number of injectors 3, e.g. as in the case of multiple injections in some of the cylinders of engine 5. In fact, after the DELAY PHASE, during the CHOPPER ON and CHOPPER OFF PHASES of one injector 3, capacitor 25 is again charged and capable of enabling the RESONANT DISCHARGING phase to drive another injector 3.

Clearly, changes may be made to control device 1 as described and illustrated herein without, however, departing from the scope of the present invention.

We claim:

1. A device for controlling inductive loads comprising:

timing means for generating timing signals for controlling injectors;

drive means for driving said inductive loads and comprising:

a number of modular circuits, one for each inductive load, said modular circuits being activated selectively and receiving said timing signals;

a common circuit comprising energy storing means, said common circuit being connected to the modular circuits and cooperating with an activated modular circuit to supply a respective inductive load; and a first input terminal and a second input terminal respectively connected, in use, to a positive pole and a negative pole of a supply source and a number of pairs of output terminals, one for each injector, each pair of output terminals comprising a first output terminal and a second output terminal between which a respective inductive load is connected in use;

each of said modular circuits comprising, in combination:

first controlled switching means connected between said first input terminal and a respective first output terminal of said drive means; and second controlled switching means connected between said respective first output terminal and said energy storing means;

said common circuit comprising:

third controlled switching means connected between said energy storing means and a respective second output terminal of said drive means, said third controlled switching means cooperating with said second controlled switching means to permit selective transfer of energy between said energy storing means and said respective inductive load.

2. A device as claimed in claim 1, said drive means also comprising a first reference potential line and a second reference potential line, and a first connecting line and a second connecting line between said modular circuits and said common circuit; said first input terminal being connected to said first reference potential line; and said second input terminal and second output terminal being connected to said second reference potential line.

3. A device as claimed in claim 2, said first controlled switching means comprising first transistor means and a first unipolar switch connected to each other in series.

4. A device as claimed in claim 3, said first transistor means comprising a charging transistor, and said first unipolar switch comprising a charging diode.

5. A device as claimed in claim 4, said charging transistor having a control terminal connected to said timing means and receiving from said timing means a first of said timing signals, a first terminal connected to said first reference potential line, and a second terminal connected to an anode terminal of said charging diode; said charging diode having a cathode terminal respectively connected to said first output terminal of said drive means.

6. A device as claimed in claim 2, said second controlled switching means comprising second transistor means and a second unipolar switch, both having respective first terminals respectively connected together to said first output terminal of said drive means, and respective second terminals connected to said energy storing means.

7. A device as claimed in claim 6, said second transistor means comprising a discharging transistor, and said second unipolar switch comprising a clamping diode.

8. A device as claimed in claim 7, said discharging transistor having a control terminal connected to said timing means and receiving from said timing means a second of said timing signals, a first terminal connected to said first connecting line, a second terminal respectively connected to said first output terminal of said drive means; said clamping diode having an anode terminal connected to said second connecting line, and a cathode terminal respectively connected to said first output terminal of said drive means.

9. A device as claimed in claim 2, said third controlled switching means comprising third transistor means and a third unipolar switch connected to each other in series; said third controlled switching means also comprising a fourth unipolar switch connected between said first connecting line and said second reference potential line.

10. A device as claimed in claim 9, said third transistor means comprising recirculating transistor; said third unipolar switch comprising a recirculating diode; and said fourth unipolar switch comprising a discharging diode (28).

11. A device as claimed in claim 10, said recirculating transistor having a control terminal connected to said timing means and receiving from said timing means a third of said timing signals, a first terminal connected to said second reference potential line, and a second terminal connected to an anode terminal of said recirculating diode; said recirculating diode having a cathode terminal connected to said second connecting line; and said discharging diode having an anode terminal connected to said second reference potential line, and a cathode terminal connected to said first connecting line.

12. A device as claimed in claim 2, said energy storing means comprising a capacitive element connected between said first connecting line and said second connecting line.

13. A device as claimed in claim 1, said first controlled switch means comprising a charging transistor; said second controlled switch means comprising a discharging transistor; said third controlled switch means comprising a recirculating transistor; and said charging transistor, said discharging transistor and said recirculating transistor being MOSFET transistors.

14. A device as claimed in claim 13, further comprising a protection diode connected between first terminal and second terminal of each of said charging transistor, said discharging transistor and said recirculating transistor.

* * * * *